US009471037B2

(12) United States Patent
Fleury et al.

(10) Patent No.: US 9,471,037 B2
(45) Date of Patent: Oct. 18, 2016

(54) SPRING FOR CLOCK MOVEMENT

(71) Applicant: ROLEX SA, Geneva (CH)

(72) Inventors: Christian Fleury, Challex (FR); Blaise Fracheboud, Plan-les-Ouates (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 14/368,707

(22) PCT Filed: Dec. 26, 2012

(86) PCT No.: PCT/EP2012/076914

§ 371 (c)(1),
(2) Date: Jun. 25, 2014

(87) PCT Pub. No.: WO2013/102600

PCT Pub. Date: Jul. 11, 2013

(65) Prior Publication Data

US 2014/0355396 A1 Dec. 4, 2014

(30) Foreign Application Priority Data

Dec. 27, 2011 (EP) ..... 11405378

(51) Int. Cl.
*G04B 19/253* (2006.01)
*G04B 11/02* (2006.01)
(Continued)

(52) U.S. Cl.
CPC ..... *G04B 11/028* (2013.01); *G04B 11/008* (2013.01); *G04B 19/25353* (2013.01); *G04B 19/25373* (2013.01); *G05G 5/06* (2013.01); *Y10T 74/20636* (2015.01)

(58) Field of Classification Search
CPC ..... G04B 19/25353; G04B 11/028; G04B 19/25373; G04B 11/008; G05G 5/06; Y10T 74/20636
USPC ..... 368/168
See application file for complete search history.

(56) References Cited

U.S. PATENT DOCUMENTS 3,609,954 A 10/1971 Hougendobler
3,626,688 A 12/1971 Bullat
(Continued)

FOREIGN PATENT DOCUMENTS

DE 6912966 U 7/1969
EP 0 360 963 A1 4/1990
(Continued)

OTHER PUBLICATIONS

International Search Report dated Jul. 25, 2013 issued in corresponding application No. PCT/EP2012/076914.
(Continued)

*Primary Examiner* — Sean Kayes
(74) *Attorney, Agent, or Firm* — Westerman, Hattori, Daniels & Adrian, LLP

(57) ABSTRACT

Spring (10) for clock mechanism, the spring comprising a body (11) extending between a first end (12) of the spring and a second end (13) of the spring, the spring being intended to be connected mechanically to a housing at each of the first and second ends, the spring comprising, between the first and the second end, at least one member (17) intended to act by contact on an element (42) of the clock mechanism, characterized in that the body comprises a deformable zone (14) extending in a curve (18) and in that the curve comprises a first part (18*a*) that is concave when viewed from the first end.

21 Claims, 2 Drawing Sheets

(51) Int. Cl.
*G04B 11/00* (2006.01)
*G05G 5/06* (2006.01)

(56) References Cited

U.S. PATENT DOCUMENTS

| | | | | |
|---|---|---|---|---|
| 3,736,743 | A | 6/1973 | Koike | |
| 3,848,400 | A | 11/1974 | Fluck et al. | |
| 3,911,667 | A | 10/1975 | Komiyama | |
| 3,983,691 | A | 10/1976 | Schaler et al. | |
| 4,634,287 | A * | 1/1987 | Vuilleumier | G04B 19/23 368/185 |
| 4,910,721 | A * | 3/1990 | Hayakawa et al. | 368/155 |
| 4,945,521 | A | 7/1990 | Klaus | |
| 4,998,230 | A | 3/1991 | Fini | |
| 5,172,351 | A * | 12/1992 | Corlet | 368/319 |
| 6,636,457 | B2 * | 10/2003 | Lin | G04G 9/0076 368/21 |
| 7,158,448 | B1 | 1/2007 | Gabathuler et al. | |
| 7,643,379 | B2 | 1/2010 | Villar et al. | |
| 2007/0019507 | A1 | 1/2007 | Gabathuler et al. | |
| 2009/0016169 | A1 | 1/2009 | Villar et al. | |
| 2011/0194382 | A1 * | 8/2011 | Fujiwara et al. | 368/112 |
| 2011/0286311 | A1 * | 11/2011 | Ono | 368/38 |
| 2012/0057434 | A1 * | 3/2012 | Rudaz | 368/28 |
| 2012/0127837 | A1 * | 5/2012 | Bode et al. | 368/220 |
| 2012/0195169 | A1 | 8/2012 | Courvoisier | |

FOREIGN PATENT DOCUMENTS

| | | | |
|---|---|---|---|
| EP | 1586961 | A2 | 10/2005 |
| EP | 1746470 | A1 | 1/2007 |
| EP | 2015146 | A1 | 1/2009 |
| EP | 2 309 346 | A1 | 4/2011 |
| FR | 2043711 | A1 | 2/1971 |
| FR | 2080602 | A1 | 11/1971 |

OTHER PUBLICATIONS

International Search Report dated Jul. 25, 2013 issued in application No. PCT/EP2012/076911, counterpart of co-pending U.S. Appl. No. 14/368,745 (2 pages).

Office Action dated Jan. 11, 2016 issued in co-pending U.S. Appl. No. 14/368,745 (machine translation of DE69129666 listed in the Office Action was already listed in a previous IDS in this application) (10 pages).

Notice of Allowance dated Apr. 25, 2016 issued in co-pending U.S. Appl. No. 14/368,745 (6 pages) (references A-D listed in the PTO892 were already listed in a previous IDS in this application).

Notice of Allowance dated Apr. 25, 2016 issued in co-pending U.S. Appl. No. 14/368,745 (with PTO892, without returned SB08; documents listed in the Office Action were already listed in a previous IDS in this application) (6 pages).

* cited by examiner

SPRING FOR CLOCK MOVEMENT

The invention relates to a spring for a horological mechanism or a spring of a horological mechanism. The invention also relates to a horological mechanism, especially a correction mechanism or a calendar mechanism, comprising such a spring. The invention also relates to a horological movement comprising such a spring or such a mechanism.

Horological mechanisms are generally provided with springs, levers and cams, which are intended to interact in order to perform various functions of a horological movement. Energy, taken from the driving device or even supplied by the wearer of the wristwatch, is thus accumulated and released by the springs in such a way as to assure the functions, all within a limited volume. In certain circumstances, the available volume does not permit the utilization of a strip spring, possibly integral with a lever, of which the extended geometry is configured in such a way as to minimize the mechanical stresses that are present within it, which results in spring geometries within which the mechanical stresses are very high in relation to the forces to be provided. Furthermore, it is not easy to adjust a spring of this kind in relation to the forces that it may be called upon to provide and the various functions that it may be called upon to perform.

Patent application FR2043711 describes a lever spring in the form of a "V", which is manufactured as a single piece. This is dedicated to a setting mechanism. Its spring part is perfectly locked by two stops, so that it flexes during the displacement of its lever part in such a way as to generate a return force. This configuration of the lever spring is not optimal in view of the angular rigidity, which is likely to require such a component part with a view to optimizing the forces at the stem and thus to maximizing the comfort for the wearer of the watch. The attachment points of the spring have an impact on the pivoting of the setting lever and on the positioning of the sliding pinion.

Patent application EP2015146A1 relates to an instantaneous jumping date function. This application discloses a conventional energy accumulator that is constituted by a spring, by a rocker and by a cam that is integral with a date function driving finger. Throughout the day, the spring, with the help of the rocker which is placed against the cam, accumulates the energy required to permit an instantaneous jump of the date. The spring is thus configured in such a way as to produce the appropriate forces to permit this jump. More specifically, the spring exhibits the form of a particularly cumbersome extended strip, the purpose of which is to reduce the mechanical stresses within it having regard for the forces that it must provide. This spring is pivoted about a single pivoting point which is situated essentially at the center of the strip. A first end of the spring is in abutment against the frame of the watch, and a second end presses against the rocker, so that the spring flexes during the displacement of the cam so as to generate a return force. It appears that, with such a configuration of the spring, the energy that can be accumulated in the spring is low at a given maximum internal stress.

One solution disclosed by patent application EP1746470A1 involves the use of "wire" springs. This design choice can offer the potential to reduce the physical size of the energy accumulation device. The bending tolerances are very difficult to guarantee, however, which makes the industrial and repeatable production of such springs problematical.

The object of the invention is to make available a spring for a horological mechanism which permits the aforementioned disadvantages to be overcome. In particular, the invention proposes a spring permitting the mechanical stresses to which it is subjected to be minimized when it is acted upon within a given space and likewise permitting the forces that it generates to be easily adjusted. The invention also proposes a spring, of which the geometry is particularly suitable for industrial production.

According to the invention, the spring for a horological mechanism comprises a body extending between a first end of the spring and a second end of the spring. The spring comprises, between the first and the second end, at least one member intended to act by contact on an element of the horological mechanism. The body comprises a deformable zone extending in a curve. The curve comprises a first part that is concave when viewed from the first end.

The spring is intended to be connected mechanically to a frame at each of the first and second ends.

Different embodiments of the spring are defined as follows:

- The spring as above, wherein the curve comprises a first part that is concave when viewed from the first end and a second part that is rectilinear or substantially rectilinear.
- The spring as above, wherein the member comprises a lever that is pivoted about a pivot axis situated at the first end, especially around the axis of a mechanical connection connecting the spring to the frame.
- The spring as above, wherein the lever is connected to the deformable zone at a distance from the pivot axis, especially at more than one third of the length of the lever, or at more than one half of the length of the lever, or at the end or substantially at the end of the lever.
- The spring as above, wherein the lever extends along a half-line comprised in a half-plane that is complementary to the half-plane in which there extends a part of the deformable zone extending in the concave part of the curve from one end of the spring, the half-planes being separated by a straight line passing through the axes of the mechanical connections connecting the spring to the frame.
- The spring as above, wherein it comprises a first element for mechanical connection to the frame at the first end and a second element for mechanical connection to the frame at the second end.
- The spring as above, wherein the spring is intended to be connected via a pivot connection to the frame at the first end, and the spring is intended to be connected via a pivot connection to the frame at the second end.
- The spring as above, wherein the distance between the first and the second ends, once the spring has been mounted on the frame, is less than 5 mm, or less than 2 mm, or less than 1 mm.
- The spring as above, wherein the distance between the first and the second ends, once the spring has been mounted on the frame, is less than 8 times the thickness of the first and second ends of the spring, and more preferably is less than 6 times the thickness of the first and second ends of the spring.
- The spring as above, wherein half-lines originating from the first end and passing respectively via the second end and the center of gravity of the body of the spring form an angle ($\gamma$) preferably of less than 120°, or less than 90°, or less than 60°.
- The spring as above, wherein the curve is a plane curve.
- The spring as above, wherein the member comprises a finger protruding on the body of the spring.

The spring as above, wherein the member comprises a cam follower mounted rotatably on the body of the spring.

The spring as above, wherein it is made of spring steel or silicon or nickel or nickel-phosphorus or an amorphous metal alloy.

The spring as above, wherein the body has a generally annular form exhibiting an opening.

The spring as above, wherein the member is intended to release energy, especially in the form of mechanical work, to the element of the horological mechanism.

A horological mechanism is defined as a horological mechanism, especially a calendar mechanism or a correction mechanism, comprising a spring as claimed in one of the preceding claims.

Different embodiments of the mechanism are defined as follows:

The horological mechanism as above, wherein it comprises a frame and an element that is mobile in relation to the frame, wherein one surface of the spring acts by contact on the mobile element, and wherein the spring and the element are arranged in such a way that the member releases energy, especially in the form of mechanical work, to the element.

The horological mechanism as above, wherein the element comprises a cam and/or a pinion and/or a wheel.

The horological mechanism as above, wherein, in the normal functioning of the mechanism, the mobile element is displaced by at least 10°, or by at least 15°, or by at least 20°, or by at least 30°, relative to the frame, and/or the mobile element is displaced by at least 0.3 mm, or by at least 0.5 mm, or by at least 0.7 mm, relative to the frame, and/or the member is displaced by at least 5°, or by at least 10°, about the axis of a connection element at the time of passage from a configuration of maximum stress in the spring to a configuration of minimum stress in the spring.

A horological mechanism is defined as a horological movement comprising a horological mechanism as above or a spring as above.

A timepiece is defined as a timepiece, especially a watch, comprising a horological movement as above or a horological mechanism as above, or a spring as above.

The accompanying drawings depict, by way of example, two variant embodiments of a horological spring according to the invention.

Figure 1:
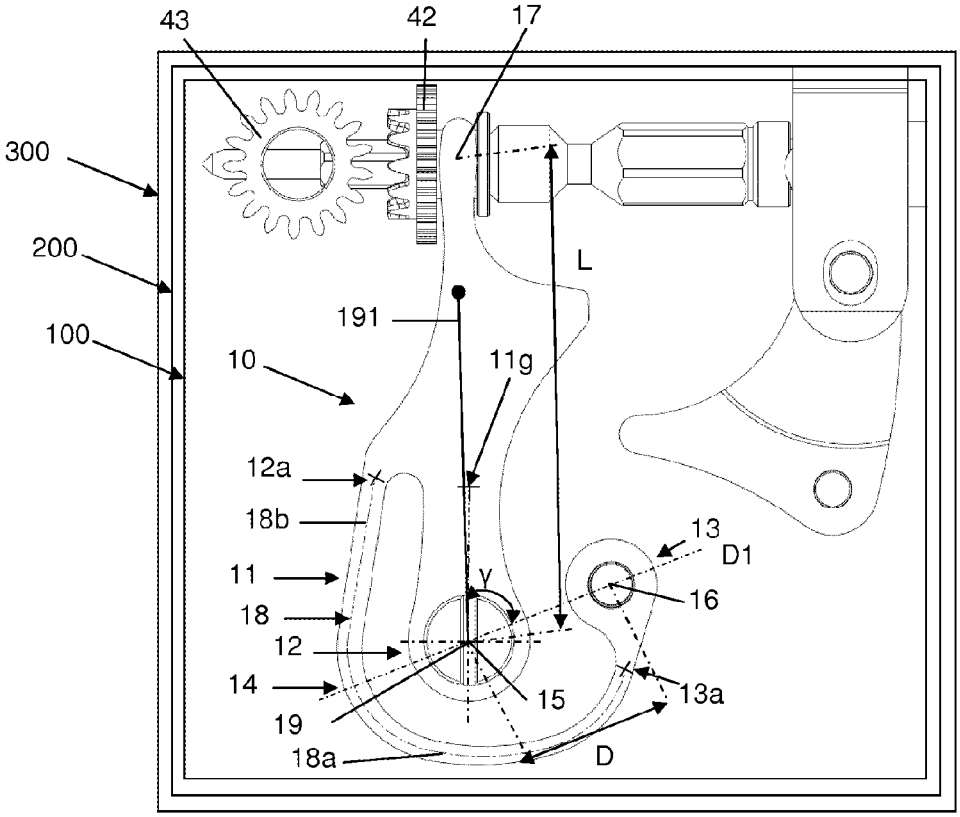
FIG. 1 is a schematic view of a timepiece exhibiting a first variant embodiment of a horological spring according to the invention.

A timepiece 300 according to the invention is described below with reference to FIG. 1. The timepiece is a watch, for example, especially a wristwatch. The timepiece comprises a horological movement 200, especially a horological movement of the mechanical type. The horological movement comprises a mechanism 100, especially a mechanism including an element 42 and a spring 10.

The invention is illustrated by two specific applications. The first relates to a lever spring of a horological correction mechanism, and the second application relates to a lever spring of a calendar mechanism. In each of these applications, the lever spring or the spring is intended to accumulate mechanical energy before subsequently releasing it to the element—being a cam or a pinion or a wheel—of the horological mechanism with which it interacts. This energy is released at least in part and almost entirely integrally in the form of mechanical work. Furthermore, in each of these applications, the spring is connected to a frame that is integral with the timepiece.

In the first variant, the horological mechanism 100 is a correction mechanism permitting, for example, the correction of the hour display, the correction of the date display or the correction of any other display. The mechanism comprises a spring 10. The mechanism also comprises a frame and an element 42 that is mobile relative to the frame. A surface of the spring acts by contact on the mobile element. The spring and the element are arranged in such a way that the member releases energy, especially in the form of mechanical work, to the element. The element comprises a cam and/or a pinion and/or a wheel. In the example in FIG. 1, the element is a sliding pinion.

A first variant of the spring is provided, for example, in order to interact by action by contact on the sliding pinion of a correction mechanism and/or a setting mechanism of the timepiece. The said pinion is capable of axial displacement between a position of engagement with a correction wheel 43 and a position of non-engagement of the pinion and the wheel. The spring permits the sliding pinion to be returned to a position of non-engagement (illustrated in FIG. 1).

The said spring 10 comprises a body 11 extending between a first end 12 of the spring and a second end 13 of the spring. The spring is intended to be connected mechanically to a frame at each of the first and second ends. The spring comprises, between the first and the second end, at least one member 17, especially a lever, intended to act by contact on the element 42 of the horological mechanism. The body comprises at least one deformable zone 14 extending in a curve 18. The curve comprises a first part 18*a* that is concave when viewed from the first end. The zone 14 has a substantially rectangular cross-section that is highly deformable under an action of a given intensity. This zone is situated between the points 12*a* and 13*a* of the respective ends 12 and 13, beyond which the cross section of the body 11 of the spring 10 varies significantly.

The spring 10, especially the lever 17, comprises a first pivoting element 15 for connecting to the frame at the first end 12. The second end 13 of the spring 10, which is notably in the continuity of the deformable zone 14 of the spring 10 or adjoining the deformable zone 14, comprises a second pivoting element 16 for connecting to the frame. The first connecting element preferably comprises a bore 15 or a bore portion intended to receive an axis mounted on the frame. Likewise, the second connecting element preferably comprises a bore or a bore portion 16 intended to receive an axis mounted on the frame. In the event of a connecting element comprising a bore portion, the spring can be a sliding fit on an axis that is fixed to the frame. The lever 17 is pivoted about a pivot axis 19 situated at the first end, especially about the axis of the mechanical connection connecting the spring to the frame.

The curve 18, along which the zone 14 extends from the body 11 of the spring 10 between the points 12*a* and 13*a*, exhibits a generally concave section 18*a* and a rectilinear or substantially rectilinear section 18*b*. This curve 18 is generally concave when viewed from the first end 12, especially from the axis 19 of the first means of connection 15.

The lever 17 is connected to the deformable zone 14 at a distance from the pivot axis 19, especially at more than one third of the length L of the lever, or at more than one half of the length L of the lever, or at the end or substantially at the end of the lever. It is considered that the contact zone of the lever with the element 42 constitutes the end of the lever, even if the lever extends physically beyond it. The length L is measured between the pivot axis 19 and the contact zone.

Preferably, once the spring has been mounted on the frame, the distance D between the first and second ends, especially between the axis of the first means of connection and the axis of the second means of connection, is less than 5 mm, or less than 2 mm, or less than 1 mm and/or is less than 8 times the thickness E of the ends 12 and 13 of the spring, and preferably less than 6 times the thickness E of the ends 12 and 13 of the spring. The thickness E of the spring is measured perpendicularly to the plane of FIG. 1.

The distance D is in the order of 2 mm, and the thickness E measured at the ends 12 and 13 is in the order of 0.3 mm within the spring 10 that is illustrated by FIG. 1.

Preferably, during normal operation of the mechanism, at the point of application of the force, the element 42 is displaced by at least 0.3 mm, or by at least 0.5 mm, or by at least 0.7 mm relative to the frame at the time of passage from a configuration of maximum stress in the spring to a configuration of minimum stress in the spring. This displacement takes place under the effect of the release of the mechanical energy stored in the spring, especially in the form of mechanical work. At the time of the said displacement, the lever 17 can be displaced by at least 5°, or by at least 10°, about the axis of a connection element 15.

The angle γ formed by the two half-lines originating from the end 12, especially the axis of the first means of connection 15, and passing respectively via the end 13, especially via the axis of the second means of connection 16, and the center of gravity 11*g* of the body 11 of the spring is preferably less than 120°, or less than 90°. The angle γ is in the order of 60° within the spring 10 that is illustrated by FIG. 1.

The straight line D1 passing through the axes of the mechanical connections connecting the spring to the frame makes it possible to define a first and a second half-plane situated to either side of the said straight line. The lever 17 extends along a half-line 191 included in the first complementary half-plane of the second half-plane, in which a part of the deformable zone extends from the second end, that is to say where a part of the deformable zone extends from the second end or directly in contact with the second end. The deformable part, being situated in the second half-plane, is preferably concave. The deformable part, being situated in the second half-plane, can comprise or can be all or part of the concave part 18*a* of the curve 18.

Figure 2:
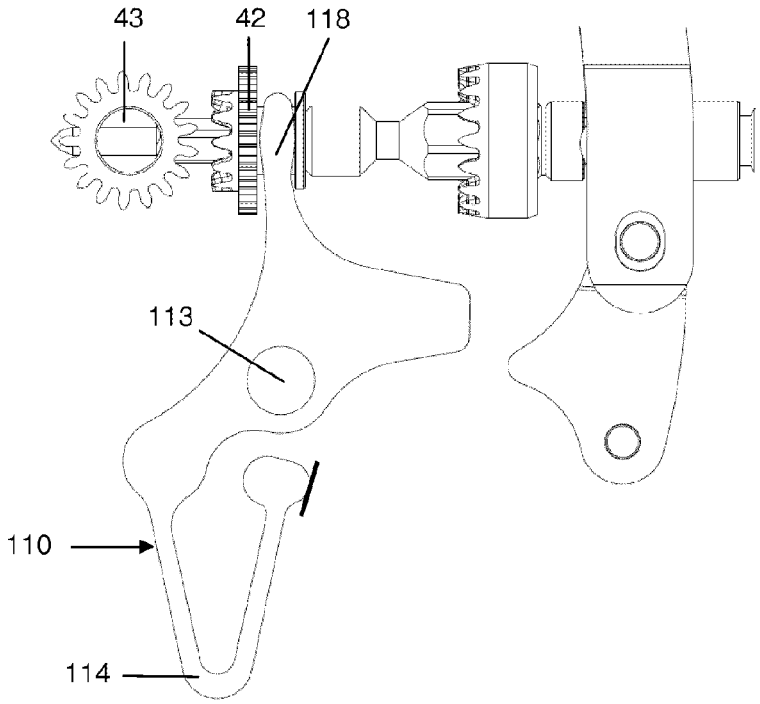
FIG. 2 is a view of a horological spring according to the prior art.

FIG. 2 illustrates a spring that is familiar from the prior art. This spring 110 is pivoted about an axis 113 and is provided in order to maintain the pinion 42 in position at a distance from a correction wheel 43, with the help of a finger 118, when a stem is arranged in a first position. The cross section of the flexible portion 114 of the spring is then defined in such a way as to guarantee the adequate holding force. The passage from a position of non-correction to a position of correction causes the wearer of the watch to pull on the stem and, in so doing, to overcome the force produced by the said spring. For a certain axial displacement of the stem, this force can be too great and can risk impairing the sensations when handling the stem.

One particularly advantageous solution, therefore, is to utilize a spring of the kind depicted in FIG. 1 within a horological mechanism, since the spring, because of its low angular rigidity, can be adapted in order to minimize the forces that are in play within the mechanism, while assuring the minimum forces that are required for the effective functioning of the device. The spring can thus be preloaded in an optimal fashion. The distance between the two connecting axes of the spring could likewise be modified in such a way as to adjust the force range that the spring is capable of producing depending on the displacement of the pinion 42. Accordingly, one and the same spring can be utilized within a plurality of horological mechanisms in which the displacement of the sliding pinion differs.

Figure 3:
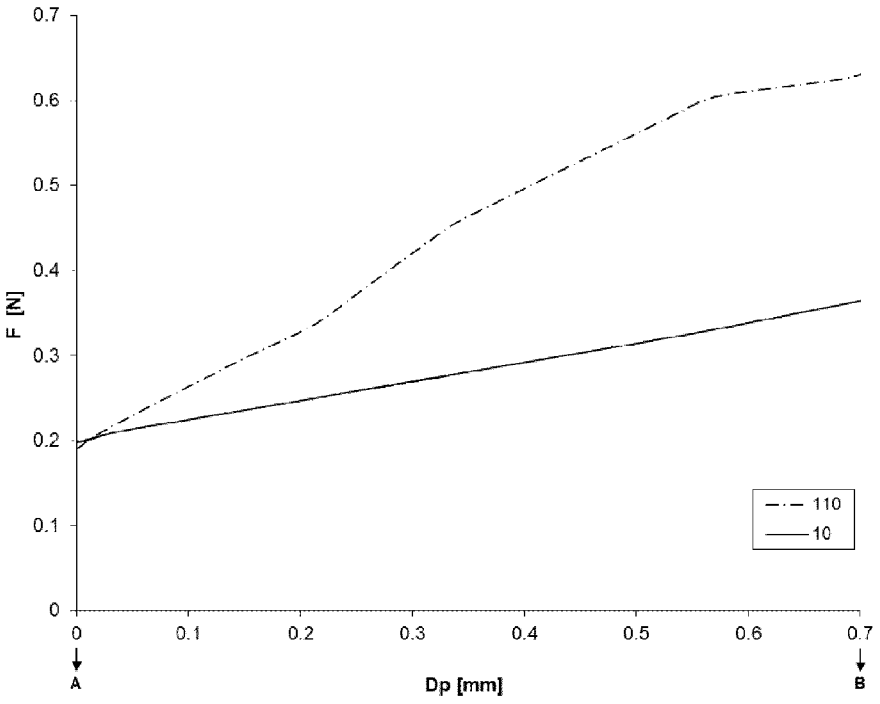
FIG. 3 is a view of a graph illustrating the path of the force supplied by a spring as a function of its deformation in the cases of the spring in FIG. 1 and the spring in FIG. 2 that are familiar from the prior art.

Compared to the spring that is familiar from the prior art, the first variant of the spring provided with the same cross section makes it possible to minimize the force of the spring that is generated by the displacement of the stem while assuring the required holding force in the non-correction position through the pre-winding of the spring, and in the same available volume. This is illustrated by the force F displacement characteristic Dp of the first embodiment of the spring and of a known spring, as represented by FIG. 2, measured between a first position of non-correction P1 and a second position of correction P2 of the pinion 42, which is represented in FIG. 3. It should be noted that, for the same installation space, a greater constancy of the return force is obtained with the spring 10 according to the invention. To put it another way, a smaller variation in the return force is obtained for a given displacement of the spring 10 according to the invention.

The second application relates to a lever spring of a calendar mechanism.

In the second variant, the horological mechanism is a calendar mechanism, for example for displaying the date. The mechanism includes a spring 20. The mechanism also includes a frame and an element 52 that is mobile in relation to the frame. One surface of the spring acts by contact on the mobile element. The spring and the element are arranged in such a way that the member releases energy, especially in the form of mechanical work, to the element. The element comprises a cam and/or a pinion and/or a wheel. In the example in FIG. 4, the element is a cam.

This second variant of the spring is provided, for example, in order to interact by action by contact on the cam of the calendar mechanism of the timepiece. The cam is movable about an axis. The spring makes it possible to return the lever into contact on the cam.

In this second variant, the spring for a horological mechanism is a spring for a calendar rocker device, for example. This spring is described below with reference to FIG. 4. The spring 20 is provided, for example, in order to interact by action by contact on the cam 52. This cam is mobile in relation to the frame. More specifically, the cam is mounted on a 24-hour wheel, which is integral with a finger 51 for driving a calendar display. Throughout the day, the spring, with the help of the cam, accumulates the energy required to permit an instantaneous jump of a calendar display. Other than its application, the second variant differs from the first variant of the second embodiment solely in respect of the elements that are described below.

The spring 20 comprises a body 21 which extends between a first end 22 of the spring and a second end 23 of the spring. The spring comprises, between the first end and the second end, a lever 27 equipped with a cam follower 27' mounted so as to rotate freely, which is intended to act by contact on the cam 52 of the horological mechanism.

The body 21 of the spring exhibits at least one zone 24 of substantially rectangular cross section that is highly deformable under an action of a given intensity. This zone is situated between the points 22*a* and 23*a* of the respective ends 22 and 23, beyond which the cross section of the body 21 of the spring 20 can vary substantially.

The spring 20, especially the lever 27, comprises a first pivoting element 25 for connecting to the frame at the first end 22. The end 23 of the spring 20, which is notably in the continuity of the deformable zone 24 of the spring 20, comprises a second pivoting element 26 for connecting to the frame at the second end 23. The first connecting element preferably comprises a bore 25 or a bore portion intended to receive an axis mounted on the frame. Likewise, the second connecting element preferably comprises a bore 26 or a bore portion intended to receive an axis mounted on the frame.

The curve 28 along which the zone 24 extends from the body 21 of the spring 20 between the points 22*a* and 23*a* exhibits a generally concave section 28*a* and a substantially rectilinear section 28*b*. This curve 28 is generally concave when viewed from the first end 22, especially from the axis of the first means of connection 25.

Figure 4:
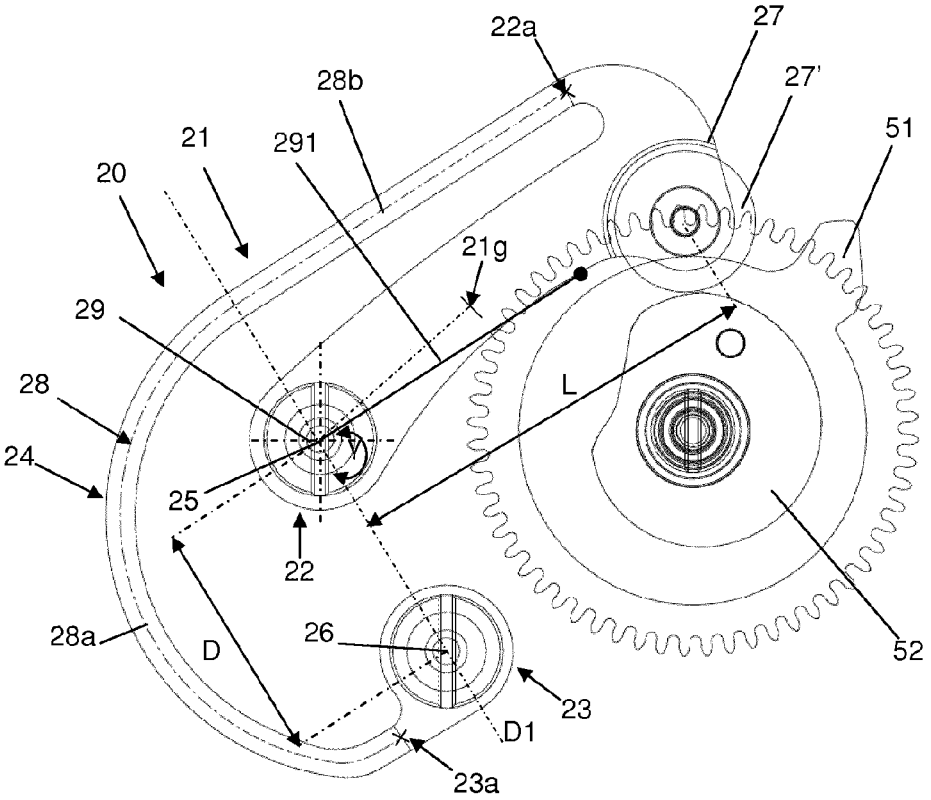
FIG. 4 is a view of a second variant of a horological spring according to the invention.

Once the spring 20 has been mounted on the frame, the distance D between the first and second ends, especially between the axis of the first means of connection 25 and the axis of the second means of connection 26, is in the order of 4 mm. The thickness E measured at the ends 22 and 23, and measured perpendicularly to the plane of FIG. 4, is in the order of 0.4 mm. The angle γ formed by the two half-lines originating from the end 22, especially the axis of the first means of connection 25, and passing respectively via the end 23, especially via the axis of the second means of connection 26, and the center of gravity 21*g* of the body 21 of the spring is in the order of 50°.

Preferably, during normal operation of the mechanism, the element 52 is displaced by at least 10°, or by at least 15°, or by at least 20°, or by at least 30°, relative to the frame at the time of passage from a configuration of maximum stress in the spring to a configuration of minimum stress in the spring. This displacement takes place under the effect of the release of the mechanical energy stored in the spring, in particular in the form of mechanical work. At the time of the said displacement, the lever 27 can be displaced by at least 5°, or by at least 10°, about the axis of a connection element 25.

A spring of this kind offers an advantageous opportunity to replace a spring strip or a "wire" spring, which can be particularly cumbersome and/or difficult to manufacture industrially. Because of its two pivoting points, the angular rigidity of the spring according to the invention permits the mechanical stresses within it to be minimized. This spring, within a limited volume, thus permits the energy accumulated during its loading to be maximized, while at the same time limiting the mechanical stresses within it.

Furthermore, the distance D between the first and second ends of the spring can be easily adjusted having regard for the various forces that the spring may be called upon to provide having regard for the various functions that it may be called upon to perform. More specifically, the distance D between the first and second ends of the spring can be adjusted in order to permit one or a plurality of jumps of a calendar display, or the jump of one or a plurality of calendar displays. A spring of this kind thus permits a plurality of functions to be performed without modifying the component parts with which it interacts, in particular the calendar cam. Thus, one and the same spring can be used within a plurality of calendars of which the functions and/or the displays differ.

Irrespective of which variant is considered, the proximity of the centers of the pivoting connecting elements allows low angular rigidity. This low angular rigidity makes it possible to optimize the range of force or torque that the spring is capable of producing, especially in the case of the first application. This low angular rigidity likewise makes it possible for the spring to maximize the energy accumulated during its loading, while at the same time limiting the mechanical stresses within it, in particular in the case of the second application. This low angular rigidity likewise makes it possible to configure the cross section of the spring in such a way as to enable this spring to be manufactured in an industrial and repeatable manner, in particular in the case of the third application.

Irrespective of which variant is considered, once the spring has been mounted on the frame, the distance between the first and second ends, especially between the axis of the first pivot and the axis of the second pivot, is preferably less than 5 mm, or less than 2 mm, or less than 1 mm and/or is less than 8 times the thickness of the ends of the spring, and preferably less than 6 times the thickness of the ends of the spring.

Irrespective of which variant is considered, the spring comprises, between the first end and the second end, at least one member intended to act by contact on an element of the horological mechanism.

Irrespective of which variant is considered, the spring has a generally annular form exhibiting an opening.

Irrespective of which variant is considered, the curve 18, 28 is preferably a plane curve. The body of the spring or the spring thus extends along a plane. Alternatively, the first end of the spring can be oriented along a first plane, and the second end can be oriented along a second plane. The first plane and the second plane are not necessarily parallel. Preferably, the axis of the first pivot is perpendicular to the first plane, and the axis of the second pivot is perpendicular to the second plane.

The curve 18, 28, along which the zone 14, 24 of the body 11, 21 extends between the points 12*a*, 22*a* and 13*a*, 23*a*, exhibits a generally concave part 18*a*, 28*a* and a substantially rectilinear part 18*b*, 28*b*. This curve 18, 28 is generally concave when viewed from the first end 12, 22, especially from the axis of the first pivot 15, 25.

Irrespective of which variant is considered, the spring can be made of different materials. It can be made, in particular, of spring steel, of silicon, of nickel, of nickel-phosphorus or of an amorphous metal alloy. The spring can be made, for example, by a mechanical process such as stamping or wire cutting. The spring can also be made by stereolithography, by a LIGA process, by a DRIE etching process, or even by a laser etching process. These production processes make it possible, in particular, to produce thin thicknesses of material at the connecting elements, which permits the axes of the mechanical connection elements to be positioned as close together as possible.

For reasons of architecture, it is possible for the member that is intended to act by contact on an element of the horological mechanism to exhibit a different thickness from that of the other parts of the spring, in particular in the case of the third application. The spring according to the invention can thus exhibit zones having different thicknesses.

Irrespective of which variant is considered, because of its low angular rigidity, the monobloc spring makes it possible to maximize the energy accumulated during its loading, while at the same time limiting the mechanical stresses within it. The spring makes it possible to provide the forces that are necessary in order to be able to perform various horological functions in a given volume. In order to do so, the monobloc spring exhibits two distinct and close pivots.

This spring thus makes it possible:

to maximize the active length of the spring;

to minimize the deformation of the spring in the course of its function;

to minimize the angular stiffness of the spring;

to minimize the stresses within the material;

to prestress the spring in an optimal manner.

The distance between the pivoting axes depends directly on the minimum material thicknesses that can be achieved by the production process.

Of course, the use of such a spring according to the invention is not restricted to the applications described previously. It is conceivable to integrate this spring within a chronograph mechanism or within a countdown mechanism, for example.

Finally, the invention also relates to a horological movement or to a timepiece, especially to a watch, comprising a horological mechanism as described previously or a spring as described previously.

Throughout this document, the expression "spring" has been used to designate a monobloc element comprising a first part that is highly deformable under an action of a given intensity and a second part, especially at the member, which is weakly deformable or non-deformable under this same action. This has been done by analogy with other uses of the expression "spring". In particular, the expression "spring" is also used in a habitual manner to designate a helicoidal spring that is subjected to tensile loading and is terminated by a hook at each of these ends. It is clear, however, that such a helicoidal spring comprises a first part (configured as a helix) that is highly deformable under an action of a given intensity, and a second part (the hooks) that is weakly deformable, or non-deformable, under this same action.

Throughout this document, the expression "body" or "spring body" designates the spring itself, that is to say the material forming the spring.

The invention claimed is:

1. A spring for a horological mechanism, the spring comprising:

a body extending between a first end of the spring and a second end of the spring, the spring being configured to be connected mechanically to a frame at each of the first and second ends, between the first and the second end, at least one lever configured to act by contact on an element of the horological mechanism, wherein the body comprises an elastically deformable zone extending in a curve, and wherein the curve comprises a first part that is concave when viewed from the first end, and wherein the elastically deformable zone comprises a second part that is rectilinear or substantially rectilinear.

2. A spring for a horological mechanism, the spring comprising:

a body extending between a first end of the spring and a second end of the spring, the spring being configured to be connected mechanically to a frame at each of the first and second ends, between the first and the second ends, at least one lever configured to act by contact on an element of the horological mechanism, wherein the body comprises an elastically deformable zone extending in a curve, and wherein the curve comprises a first part that is concave when viewed from the first end, wherein the lever is pivoted about a pivot axis situated at the first end, wherein the lever connects to the spring body at a distance from the first end, wherein a zone of the spring located toward the first end when viewed from the elastically deformable zone is less deformable than the elastically deformable zone.

3. The spring as claimed in claim 2, wherein the lever is connected to the elastically deformable zone at a distance from the pivot axis.

4. The spring as claimed in claim 2, which comprises a first element for mechanical connection to the frame at the first end and a second element for mechanical connection to the frame at the second end.

5. The spring as claimed in claim 2, wherein the spring is configured to be connected via a first pivot connection to a frame at the first end, and the spring is configured to be connected via a second pivot connection to the frame at the second end.

6. The spring as claimed in claim 2, wherein the distance between the first and the second ends, once the spring has been mounted on the frame, is less than 5 mm.

7. The spring as claimed in claim 2, wherein the distance between the first and the second ends, once the spring has been mounted on the frame, is less than 8 times the thickness of the first and second ends of the spring.

8. The spring as claimed in claim 2, wherein half-lines originating from the first end and passing respectively via the second end and the center of gravity of the body of the spring form an angle of less than 120°.

9. The spring as claimed in claim 2, wherein the curve is a plane curve.

10. The spring as claimed in claim 2, wherein the lever comprises a finger protruding on the body of the spring.

11. The spring as claimed in claim 2, which is made of spring steel or silicon or nickel or nickel-phosphorus or an amorphous metal alloy.

12. The spring as claimed in claim 2, wherein the body has a generally annular form exhibiting an opening.

13. The spring as claimed in claim 2, wherein the lever is intended to release energy to the element of the horological mechanism.

14. Horological mechanism comprising a spring as claimed in claim 3.

15. Horological mechanism as claimed in claim 14, which comprises a frame and an element that is mobile in relation to the frame, wherein one surface of the spring acts by contact on the mobile element, and wherein the spring and the element are arranged in such a way that the lever releases energy to the element.

16. Horological mechanism as claimed in claim 14, wherein the element comprises a cam and/or a pinion and/or a wheel.

17. Horological mechanism as claimed in claim 14, wherein, in the normal functioning of the mechanism, the mobile element is displaced by at least 10° relative to the frame, and/or the mobile element is displaced by at least 0.3 mm relative to the frame, and/or the lever is displaced by at least 5° about the axis of a connection element at the time of passage from a configuration of maximum stress in the spring to a configuration of minimum stress in the spring.

18. Horological movement comprising a horological mechanism as claimed in claim 14.

19. Timepiece comprising a spring as claimed in claim 2.

20. A spring for a horological mechanism, the spring comprising:

a body extending between a first end of the spring and a second end of the spring, the spring being configured to be connected mechanically to a frame at each of the first and second ends, between the first and second ends, at least one lever configured to act by contact on an element of the horological mechanism, wherein the body comprises an elastically deformable zone extending in a curve, and wherein the curve comprises a first part that is concave when viewed from the first end, wherein the lever is pivoted about a pivot axis situated at the first end, and wherein the lever extends along a half-line comprised in a second half-plane that is complementary to a first half-plane in which there extends a part of the deformable zone extending in the concave first part of the curve from one end of the spring, the first and second half-planes being separated by a straight line passing through axes of mechanical connections for connecting the spring to the frame.

21. A spring for a horological mechanism, the spring comprising:

a body extending between a first end of the spring and a second end of the spring, the spring being configured to be connected mechanically to a frame at each of the first and second ends, between the first and second ends, at least one lever configured to act by contact on an element of the horological mechanism, wherein the body comprises an elastically deformable zone extending in a curve, and wherein the curve comprises a first part that is concave when viewed from the first end, and wherein the lever comprises a cam follower mounted rotatably on the body of the spring.

* * * * *